United States Patent [19]

Mahrle

[11] Patent Number: 4,729,908

[45] Date of Patent: Mar. 8, 1988

[54] METHOD FOR MAKING DECORATIVE PLASTIC WEBS OR SHEETS, DEVICE FOR CARRYING OUT THE METHOD, AND DECORATIVE PLASTIC WEB OR SHEET

[75] Inventor: Heinz Mahrle, Ronneby, Sweden

[73] Assignee: Tarkett AB, Sweden

[21] Appl. No.: 828,639

[22] Filed: Feb. 11, 1986

[30] Foreign Application Priority Data

Feb. 14, 1985 [SE] Sweden ..... 8500676

[51] Int. Cl.[4] ..... B05D 1/02

[52] U.S. Cl. ..... 427/286; 427/256; 427/288; 427/365; 427/424; 427/421; 118/313

[58] Field of Search ..... 427/288, 256, 286, 365, 427/424, 421; 118/313

[56] References Cited

U.S. PATENT DOCUMENTS

| | | | |
|---|---|---|---|
| 430,707 | 6/1890 | Strahan | 427/288 |
| 3,682,131 | 8/1972 | Algeri et al. | 118/2 |
| 4,005,230 | 1/1977 | Fleissner | 427/288 |
| 4,055,868 | 11/1977 | O'Neill | 427/286 X |
| 4,116,626 | 9/1978 | Varner | 427/288 X |
| 4,387,123 | 6/1983 | Wollam et al. | 427/286 |
| 4,463,467 | 8/1984 | Gruber et al. | 427/288 X |
| 4,577,585 | 3/1986 | Anselmo | 427/424 X |

FOREIGN PATENT DOCUMENTS 210018 12/1967 Sweden .

*Primary Examiner*—Beck, Shrive P.
*Attorney, Agent, or Firm*—Steele, Gould & Fried

[57] ABSTRACT

A decorative web or sheet of plastic material is obtained by spraying plastic material of different color and/or structure onto a carrier web by means of nozzles, the carrier web and the nozzles being movable in relation to each other, such that the nozzles can be placed over different, predetermined areas of the carrier web. The relative movement is controlled by means of a computer programmed with the desired web or sheet pattern. A suitable installation for carrying out the method has means for transporting the carrier web in one direction and carries nozzles which are movable parallel to the carrier web in two planes at right angles to each other. By means of the nozzles, plastic material is sprayed onto the carrier web in predetermined areas and to the desired thickness. A decorative web or sheet thus obtained consists of pattern-forming areas of plastic material of different color and/or structure, which extend throughout at least a substantial part of the thickness of the web or sheet and are fused together along adjoining peripheral edges.

9 Claims, 1 Drawing Figure

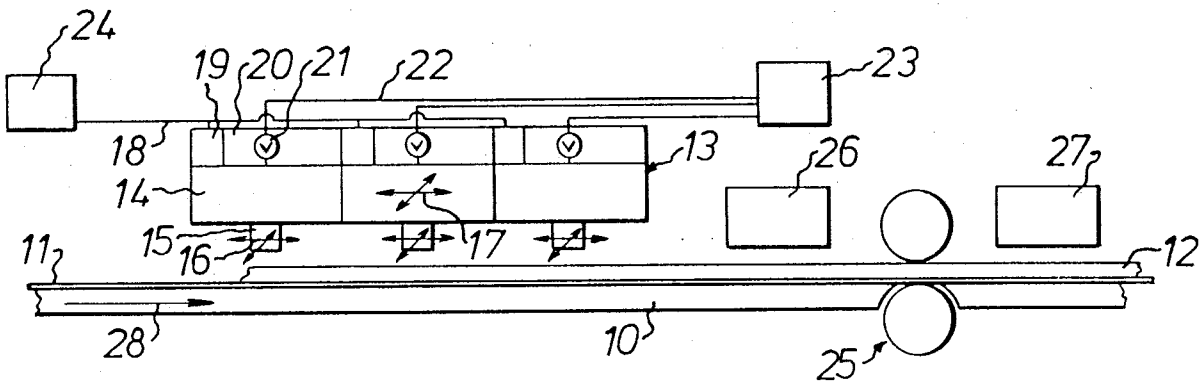
24
23
22
21
20
19
18
13
14
15
16
17
26
27
12
25
10
11
28

METHOD FOR MAKING DECORATIVE PLASTIC WEBS OR SHEETS, DEVICE FOR CARRYING OUTE THE METHOD, AND DECORATIVE PLASTIC WEB OR SHEET

The present invention relates to a method for making decorative plastic webs or sheets, in which plastic material of sprayable type, especially thermoplastic material, is applied to a carrier web and thereafter cured.

Decorative plastic webs or sheets are basically manufactured according to two different techniques. One technique involves applying a pattern which has the character of thin printed pattern films of high pigment concentration and small thickness, usually 0.010–0.050 mm and, in exceptional cases, 0.100 mm, to a plastic carrier layer, and covering it with a transparent surface layer. The other technique involves fusing together differently coloured granules, paste droplets, powders etc. so as to form irregularly marbled, layers which may have a substantial thickness. These layers can also be laminated so as to obtain products of any thickness having the same pattern throughout the entire thickness of the product.

The major advantage of the first-mentioned technique is that the plastic web or shoot can be provided with any desired pattern, text etc. One drawback is however that the pattern must be protected by the wearing layer, which reduces to some extent the impression of the pattern and also is decesive of the wearing strength of the product. If this layer is worn out, the thin pattern layer will soon be ruined, and the web or sheet must be discarded for aesthetic reasons although it still fulfils its function. A web or sheet manufactured according to the second technique has the advantage of being very resistant to wear but is highly restricted as to the choice of pattern because only marbled products can be obtained.

The object of the present invention is to provide a method for making plastic webs or sheets, combining the advantages of the above-mentioned techniques and obviating the drawbacks thereof.

According to the invention, this object is achieved in that plastic material of different colour and/or structure is sprayed by means of nozzles onto the carrier web in different areas at predetermined time intervals during which the nozzles and the carrier web are displaced in relation to each other.

The invention also relates to a device for making decorative plastic webs or sheets. The device comprises an installation for receiving a carrier web and transporting it in at least one direction, and means for applying plastic material to the carrier web, and is characterized in that said means comprise nozzles which are disposed above said carrier web, directed towards it and provided with valves, said nozzles being connected to a supply of plastic material of different colour and/or structure, that the nozzles and the carrier web are movable in relation to each other, such that the nozzles can be placed over different areas of said carrier web for discharging plastic material in said areas in a predetermined pattern, and that means are arranged for controlling said relative movement.

A plastic web or sheet manufactured by the method and the device is characterized in that it consists of pattern-forming portions of plastic material of different colour and/or structure which extend throughout a substantial portion of the thickness of the web or sheet and are fused together along adjoining peripheral edges.

The invention will now be described in more detail hereinbelow with reference to the accompanying drawing which schematically illustrates the principle of the invention.

According to the invention, decorative plastic webs or sheets are manufactured in that plastic material of different colour and/or structure is sprayed onto a carrier web by means of nozzles which discharge a predetermined amount of plastic material in a predetermined area and which are thereafter placed over another area for discharging plastic material therein, and so forth. This procedure necessitates a relative displacement of nozzle and carrier web. Such relative movement can be obtained by displacing either the nozzles or the carrier web. In practice, it is more convenient to displace the nozzles, as illustrated in the drawing, in which a supporting table included in the installation for making a decorative plastic web is designated 10 and is arranged for transporting a carrier web 11 in the direction indicated by the arrow 28, with the aid of conventional means well known to the skilled reader. The carrier web 11 may consist of a paper web which can be retained on the product or removed therefrom in a subsequent step. The carrier web 11 may also be a reinforcing web, for instance a web of glass fibre fabric, or a plastic web. Plastic material 12 is applied to the carrier web 11 by means of a discharge device 13. The device 13 consists of a number of identical, interconnected parts, each of which has a nozzle 15, a control unit 14 for the nozzle 15, an electric unit 19, and a valve unit 20. The control unit 14 has suitable mechanical, pneumatic and/or electric means for displacing the nozzle parallel to the carrier web 11 in two planes at right angles to each other, as illustrated by the intersecting arrows 16. The electric unit 19 has connections and electronic means required for actuating the means in the control unit 14. The valve unit 20 has a quick-acting solenoid valve connected in a conduit 22 for conveying plastic material from a supply 23 to the nozzle 15. The unit 20 may also contain other means necessary for feeding plastic material to the nozzle. The electric unit 19 is connected by a line 18 to a computer 24. The nozzles 15 in the different parts of the device 13 are movable independently of each other and, further, the entire device 13 can be movable in two planes at right angles to each other, as indicated by the intersecting arrows 17. After the device for supplying plastic material as counted in the direction of movement 28 of the carrier web 11, there are provided two curing-devices 26, 27 between which there is disposed a press 25 in the form of two press rolls through the nip of which the carrier web 11, with a plastic layer 12 applied thereto, is passed. Only three nozzles are illustrated in the drawing, but any required number may of course be provided, and it goes without saying that the nozzles should be able to move throughout the entire width of the web. For wide webs, it may be advantageous to provide several nozzles after each other in the transverse direction of the web. The nozzles with associated units 14, 19 and 20 need of course not be joined together as shown in the drawing, but can also be freely movable in relation to each other. The essential thing is that the nozzles can be quickly placed over different areas of the carrier web 11.

A decorative plastic web is manufactured in the following web. The computer 24 is first provided with a pattern program for controlling the different nozzles 15.

A suitable plastic material, preferably thermoplastic material, is selected and placed in the supply 23 which has several compartments for holding materials of different colour and/or structure. Each compartment is connected to a nozzle or a group of nozzles. The plastic material used must of course have a consistency suitable for spraying. In the manufacture of the decorative web, the nozzles 15 are located over a respective area where a predetermined amount of plastic material is discharged by actuation of the associated valve 21. When the plastic material has been discharged, the nozzles 15 are moved to a new location by means of the computer 24, and plastic material is again discharged, and so forth. The carrier web 11 may be moving as the plastic material is discharged or stand still until a predetermined length of the carrier web has been covered with plastic material, whereupon it is advanced a predetermined distance. In addition to the movable nozzles 15, it is of course also possible to provide stationary nozzles which continuously supply the carrier web with plastic material.

The size of the nozzles 15 is preferably selected according to the pattern concerned. Thus, large nozzles 15 can be used in combination with narrow nozzles which discharge the plastic material in a punctiform manner.

The plastic material is so applied to the carrier web 11 that the contemplated areas are filled with material which along its peripheral edge will adjoin material applied in other areas. In order to safely ensure that a tight plastic web is obtained, the formed web must be pressed, which may be effected by means of press rolls, as shown at 25 in the drawing, optionally after precuring of the plastic material by means of a precuring device 26, whereupon final curing can be effected after the pressing operation by means of a final curing device 27.

The thickness of the decorative plastic layer is determined by the amount of plastic material applied in each area, and it is evident that both thick plastic webs with patterns extending throughout the entire thickness of the web, and webs having a plastic carrier web with a relatively thin pattern layer thereon can be obtained. By "thin" is here meant a pattern thickness of down to 0.3 mm.

The product according to the invention need not have any transparent protective wearing layer on its surface, whereby the decoration pattern or text can be perceived more directly. The product can be used as floor and wall coverings, traffic markings, for advertising purposes etc.

What I claim and desire to secure by Letters Patent is:

1. Method for making decorative plastic webs having pattern forming areas extending throughout at least a substantial part of the thickness of the web, wherein plastic materials of sprayable type and of different appearance are sprayed in a predetermined amount by means of nozzles onto a carrier web in different areas at predetermined time intervals during which said nozzles and said carrier web are displaced in relation to each other, said nozzles being moved independently of each other throughout the entire width of the web whereupon said plastic materials are cured.

2. Method as claimed in claim 1, wherein the plastic materials are of the same type but of different color.

3. Method as claimed in claim 1, wherein the plastic materials are different.

4. Method as claimed in claim 1, wherein plastic material is also continuously supplied to the carrier web.

5. Method as claimed in claim 1, wherein the carrier web with the plastic material applied thereto is pressed between press rolls.

6. Method as claimed in claim 1 wherein said nozzles are displaced relative to said web.

7. Method as claimed in claim 6 wherein said nozzles are displaced parallel to said web in two planes at right angles to each other.

8. Method as claimed in claim 1 wherein said nozzles are moved independently of each other throughout the entire width of the web.

9. Method as claimed in claim 1 wherein the plastic web which is formed is a floor covering.

* * * * *